US005095955A

United States Patent [19]

Barnewitz et al.

[11] Patent Number: 5,095,955

[45] Date of Patent: Mar. 17, 1992

[54] PROCESS AND A DEVICE FOR THE FILLING OF DOUGHY FILLING MATERIAL INTO RECEPTACLES

[75] Inventors: Manfred Barnewitz; Hans F. Pingel, both of Plettenberg-Ohle; Georg Vogt, Finnentrop-Hülschotten, all of Fed. Rep. of Germany

[73] Assignee: Alcan Deutschland GmbH, Gottingen, Fed. Rep. of Germany

[21] Appl. No.: 673,859

[22] Filed: Mar. 21, 1991

Related U.S. Application Data

[63] Continuation of Ser. No. 399,487, filed as PCT/EP88/00491, Jun. 1, 1988, abandoned.

[30] Foreign Application Priority Data

Jun. 5, 1987 [DE] Fed. Rep. of Germany .... 3718950.6

[51] Int. Cl.[5] ..... B65B 43/58; B65B 37/16

[52] U.S. Cl. ..... 141/1; 141/34; 141/264; 141/270; 141/275; 141/172; 222/142.9; 222/548; 53/242; 53/513

[58] Field of Search ..... 141/1, 11, 34, 71, 144, 141/145, 148-150, 165, 270, 171, 172, 250-255, 263-266, 275-280, 283, 284; 198/377, 379, 380, 801, 803.5, 803.14, 803.15; 222/142.6, 142.9, 185, 548; 53/242, 243, 435, 471, 473, 513-519

[56] References Cited

U.S. PATENT DOCUMENTS

| | | | |
|---|---|---|---|
| 1,210,501 | 1/1917 | Luellen | 141/250 X |
| 1,523,122 | 1/1925 | Hellmann | 222/548 X |
| 2,103,817 | 12/1937 | Johnson | 141/276 X |
| 2,127,615 | 8/1938 | Peters et al. | 141/277 X |
| 2,174,335 | 9/1939 | Tear | 141/34 |
| 2,621,833 | 12/1952 | Eklund | 222/548 |
| 2,651,445 | 9/1953 | Kennedy, Jr. | 141/264 X |
| 3,090,478 | 5/1963 | Stanley | 198/803.15 |
| 3,100,588 | 8/1963 | Pearson, Jr. | 222/185 X |
| 3,123,257 | 3/1964 | Miller | 222/185 |
| 3,124,916 | 3/1964 | Anderson et al. | 53/471 |
| 3,220,445 | 11/1965 | Taisey | 141/165 X |
| 3,267,971 | 8/1966 | Mueller | 141/264 X |
| 3,520,337 | 7/1970 | Irland et al. | 141/34 X |
| 3,538,997 | 11/1970 | Christine | 198/803.15 |
| 3,579,950 | 5/1971 | Davis | 141/171 X |
| 3,903,676 | 9/1975 | Kinney | 53/282 X |
| 4,246,300 | 1/1981 | Jensen | 198/377 X |
| 4,297,828 | 11/1981 | Krieger et al. | 53/282 |
| 4,388,795 | 6/1983 | Stohlquist et al. | 53/435 |
| 4,506,710 | 3/1985 | Sawvel | 141/283 X |
| 4,511,025 | 4/1985 | Nakayama | 198/377 |
| 4,712,665 | 12/1987 | McDonald et al. | 141/172 X |
| 4,966,205 | 10/1990 | Tanaka | 141/270 X |

FOREIGN PATENT DOCUMENTS

| | | | |
|---|---|---|---|
| 0033249 | 3/1973 | Australia | 53/282 |
| 3605422 | 8/1987 | Fed. Rep. of Germany . | |
| 2280554 | 2/1976 | France . | |
| 0153313 | 1/1956 | Sweden | 53/276 |
| 2084970 | 4/1982 | United Kingdom . | |

*Primary Examiner*—Henry J. Recla
*Assistant Examiner*—Casey Jacyna
*Attorney, Agent, or Firm*—Cooper & Dunham

[57] ABSTRACT

To fill receptacles (2) uniformly, without air inclusions and without soiling, the filling material is pressed into the continuously enlarging space between the receptacle bottom and a counter-bottom attached to the end of the filling head (1) facing the receptacle bottom and eccentrically traversed by the outlet opening (17) and at the same time the counter-bottom is rotated relative to the receptacle by the central axis.

20 Claims, 1 Drawing Sheet

PROCESS AND A DEVICE FOR THE FILLING OF DOUGHY FILLING MATERIAL INTO RECEPTACLES

This is a continuation of application Ser. No. 399,487, filed Aug. 31, 1989 (dutemotional application No. PCT/EP88/00491 filed June 1, 1988), now abandoned.

BACKGROUND OF THE INVENTION

The invention relates to a process for the filling of receptacles with doughy filling material by means of a filling head, which is provided with an outlet opening for the filling material, the receptacle to be filled being moved upwardly, along a vertical axis which it has in common with the filling head, into a position in which the receptacle bottom is at or close to the filling head and the filling material then being pressed out of the filling head and into the receptacle under the action of a pressing force while the receptacle is simultaneously returned in a relative movement from the filling head.

The invention relates furthermore to a device for carrying out this process.

A process and a device of this mentioned type are e.g. described in the DE-OS 19 38 298, the DE-OS 30 41 885, the DE-OS 31 35 244, the U.S. Pat. No. 3,124,916 and the U.S. Pat. No. 3,172,435. The devices known from this prior art use a nozzle as filling head onto which the receptacle to be filled can be slipped with little clearance and whose outlet opening corresponds substantially to the cross-section of the receptacle to be filled or the receptacle bottom as regards shape and size. The filling material to be filled in is located in a feeding reservoir connected to the nozzle by a pipeline. The filling material is acted upon with a certain pressing out force in this feeding reservoir and supplied thereby to the nozzle via the pipeline. This pressing out force must not exceed a maximum value, because otherwise the filling material pressed into the receptacle gushes out between the receptacle wall and the filling head.

This arrangement leads in particular in the case of viscous pastelike and inhomogeneous filling material such as e.g. lumpy and/or fibrous filling material with non-uniform density distribution as well as air inclusions to the fact that the limited pressing out pressure exerted in the feeding reservoir is transmitted through the inhomogeneous filling material strand to the receptacle bottom in a non-uniform manner, this being a result of the filling material having a relatively great length and a comparatively large diameter in accordance with the nozzle cross-section. Consequently, the non-uniform density distribution is also maintained in the filling material strand pressed into the receptacle and air inclusions are only insufficiently removed. However, air inclusions lead to a premature spoiling of the receptacle content and also to an over-charging of the receptacle so that filling material protrudes and the closing of the receptacle is rendered difficult. In particular in the case of receptacles with a continuous edge flange, onto which a cover is to be sealed, an over-charging of the receptacle and thus a soiling of the edge flange means an insufficient tightness of the sealing closure. Also in this case the content of the receptacle can be spoiled prematurely.

A further disadvantage of a filling head known from the prior art in the form of the aforementioned nozzle consists in that due to the spatial conditions the nozzle cannot be equipped with a cutting means for separating the filling material strand after the completion of the filling process. A separation of the filling material strand is e.g. effected in the device known from the U.S. Pat. No. 3,124,916 by a movement of the filled receptacle transversely to the nozzle to shear off the filling material filled in from the filling material strand leaving the nozzle. It is disadvantageous here that in particular in the case of viscous pastelike and sticky filling material such material is withdrawn from the area of the receptacle being in front in the direction of movement and accumulates in the rear area in the form of a bead of material, a soiling of the edge flange of the receptacle by the bead of material not being excluded. To avoid this the receptacle is for instance rotated about its axis by 180° after the shearing off of the filling material strand in the device known from the U.S. Pat. No. 3,172,435 so that the bead of material gets into the front area of the receptacle, is taken by the cover upon the closing of the receptacle and pressed back into the receptacle. Also here the spilling of filling material over the sides of the receptacle and the soiling of the receptacle edge cannot be excluded. The DE-OS 31 35 244 suggests on the other hand to control the distance of the receptacle from the nozzle during the shearing off so that initially the filling material is sheared off at a level above the upper edge of the receptacle and that subsequently after the reduction of the distance between the receptacle and the nozzle the rear upper edge of the receptacle wipes across the lower edge of the nozzle. Apart from the considerable constructional and control-technique expenditure for this control, soilings of the upper edge of the receptacle can neither be excluded here, in particular because the shearing level is not exactly defined. Moreover there is in general the risk during the shearing off of the filling material strand that the side of the nozzle being in front in the direction of the shearing movement is also soiled and that due to this soiling the upper edges of empty receptacles introduced into the device are also soiled.

A filling machine for viscous filling material is known from the DE-OS 23 30 699, whose filling head almost filling up the cross-section of the receptacle has an outlet opening which corresponds to about half the cross-sectional surface of the filling head and thus makes the use of a cutting means in the form of a knife and a counter-knife at the filling head possible. However, this known filling machine has the disadvantage that the filling head remains completely within the space enclosed by the receptacle during the actuation of the cutting means so that the receptacle cannot be completely filled and thus not be closed without air inclusions. A further disadvantage consists in that during the filling operation the distance between the filling head and the receptacle bottom is not changed as opposed to the process of the genus so that there is the risk during the filling in of in particular viscous pastelike filling material that the filling material strand filled only into one half of the cross-section of the receptacle tilts over in the direction of the non-filled half of the cross-section of the receptacle when a certain height in the receptacle is reached and thus includes air. Since the cross-section of the filling material strand corresponds to about half the cross-section of the receptacle bottom, the included air cannot escape through the overturned part of the filling material strand. Thus in this device which is of another genus the same disadvantages caused by air inclusions occur as in the prior art according to the genus.

SUMMARY OF THE INVENTION

Starting from the prior art it is the object of the invention to further develop the process and the device of the type mentioned at the beginning so that receptacles can also be filled with viscous pastelike and inhomogenous filling material in uniform fashion and largely without the inclusion of air and without soiling the edge of the receptacle.

This is achieved by the process by the fact that the filling material is pressed in the form of a filling material strand with comparably small cross-sectional surface eccentrically to the central axis into the continuously enlarging space between the receptacle bottom and a counter-bottom attached to the end of the filling head facing the receptacle bottom and being traversed by the outlet opening and that during this filling operation the receptacle is at least temporarily rotated about the common vertical central axis relative to the counter-bottom. According to the device the object is solved by the fact that the filling head comprises at its end facing the receptacle bottom a counter-bottom traversed by the outlet opening having a comparatively smaller size eccentrically to the central axis, about whose central axis the receptacle receiving means can be rotated.

Now the filling material is pressed through the outlet opening of comparatively small size and thus precompressed so that the discharged filling material strand is largely without air inclusions. Since the precompression of the filling material is effected in the filling head instead of in the receptacle larger pressing out forces can be used than has been the case so far without there being the risk that the filling material gushes out between the receptacle and the filling head. The compressed filling material strand is distributed extremely uniformly across the entire cross-section of the receptacle due to its relatively small cross-section in combinatory interaction with the eccentric filling in, the relative rotation of the receptacle to the filling head and the centrifugal force acting thus on the filling material. Unfilled points or cavities do no longer occur. The returning of the receptacle receiving means with the receptacle from the filling head during the filling operation which returning is effected in relative movement makes it e.g. possible to maintain such a small distance between the counter-bottom and the filling material filled in that due to the eccentric filling and the relative rotation the filling material strand being filled obliquely to the receptacle bottom into the receptacle has a correspondingly small length. In the case of a larger length there is the risk that the filling material strand is torn in the case of especially lumpy and a not very sticky filling material and falls into the receptacle section-wise, the non-filled points between the individual sections being superimposed, but not filled by the filling material filled in subsequently. The relative rotation of the receptacle to the filling head can be continuously steady or intermittingly according to a given programme. In this fashion the viscous pastelike and inhomogeneous filling material is filled into the receptacle uniformly, largely free from air inclusions and thus without over-charging and thus without soiling the receptacle edge. The receptacles can be perfectly closed. This is in particular of importance in the case of receptacles to be sealed. The ratio of sizes between the counter-bottom and the comparatively small outlet opening make it possible to attach a constructionally simple cutting means at the filling head and to thus cleanly separate the filling material strand in an exactly defined plane in a simple process technique fashion.

A further advantage of the invention is that in the case of especially sticky filling material the counter-bottom is kept at a distance from the filling material filled into the receptacle during the filling operation, e.g. by means of a positive control by means of a cam plate. In this fashion an adhesion of the filling material at the filling head and thus an inaccurate filling and soiling of the receptacle edge flange are avoided.

In the case of especially lumpy filling material of low stickiness it is, on the other hand, advantageous to apply pressure to the filling material filled into the receptacle during the filling operation by pressing it against the counter-bottom and to compress it additionally thereby. This can e.g. be effected by the said positive control, but also by the fact that the receptacle can be returned from the filling head in a relative movement decelerated by a counter-force being smaller than the pressing out force. The counter-bottom is preferably substantially designed congruently to the receptacle bottom.

During the filling operation the receptacle can be acted upon at least temporarily by a reaction force exceeding the pressing out force so that the relative movement between the receptacle bottom and the counter-bottom leading to the distance enlargement is decelerated, stopped or even reversed and thus the filling material filled in can be compressed and homogenized once again.

The filling head is preferably designed as a cylinder traversed by a filling duct opening into the outlet opening, the lower cylinder surface of the cylinder representing the counter-bottom.

After the termination of the filling operation the receptacle is advantageously rotated about the common central axis in relative rotation to the filling head. Due to this continued relative rotation the filling material filled into the receptacle and possibly adhering to the counter-bottom is detached from the same and from the filling material strand in an exactly defined plane. The eccentric arrangement of the outlet opening is especially advantageous here. In addition the receptacle can be returned in relative movement from the filling head during this relative rotation of the receptacle to the counter bottom after the completion of the filling operation, so that the filling material strand is torn off at the counter-bottom. Moreover the filling material strand leaving the outlet opening during this relative movement can be separated in an exactly defined plane by means of a cutting means. This cutting means for the separation of the filling material strand discharged from the outlet opening is advantageously designed as a hollow cylinder surrounding the lower part of the cylinder and containing the cylinder rotatable relative to the hollow cylinder, and with a hollow cylinder bottom resting against the lower cylinder surface and representing the counter-bottom and having a passage opening for the filling material which passage opening is disposed eccentrically to the common vertical central axis, whereby an open position of the filling head with the passage opening being superimposed by the outlet opening can be converted by the relative rotation of the cylinder to a closing position, in which the outlet opening is remote from the passage opening.

This design of the filling head offers in simple fashion the possibility to fill in the filling material eccentrically into the area of the receptacle being in the front in the advance direction in a process with the known process step of the removal of the filled receptacle from the filling head area by an advance movement being substantially directed transversely to the filling head central axis. A remainder of the filling material strand possibly projecting from the filling material filled in then tilts towards the centre of the receptacle if the same is removed from the filling head area with a correspondingly high acceleration. In this fashion the filling material is filled with uniform filling level into the receptacle and soiling of the receptacle edge is reliably avoided.

The receptacle, which is disposed on a support cage during the filling operation, which is both rotatable about the central axis it has in common with the filling head and is movable to and fro vertically relative to the filling head, is transferred from the support cage to a receptacle transport means for the laterally directed transport with high accelerations towards the outside of the filling head range.

The simple construction of the device according to the invention permits also a retooling of already existing filling systems without any difficulties.

BRIEF DESCRIPTION OF THE DRAWINGS

In the following the invention is described in more detail with reference to the drawing. The drawing comprises the FIGS. 1 to 6 and shows in schematic representation the process course according to the invention in the variant according to claim 2 using an example of embodiment of the device according to the invention.

DESCRIPTION OF THE PREFERRED EMBODIMENT

Figure 1:
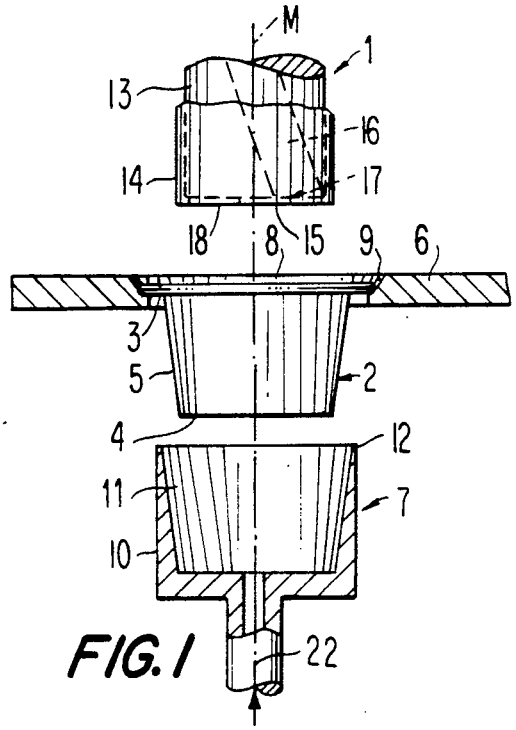

The device according to the invention is represented in the drawing only with the components essential for the invention, because, for the rest, it is of conventional design. These components are a filling head 1 and a support means to receive a receptacle 2 with an outwardly directed, continuous receptacle edge flange 3, a receptacle bottom 4 and receptacle walls 5 converging slightly conically in the direction to the latter. The support means consists of a transport plate 6 and a support cage 7.

Figure 4:
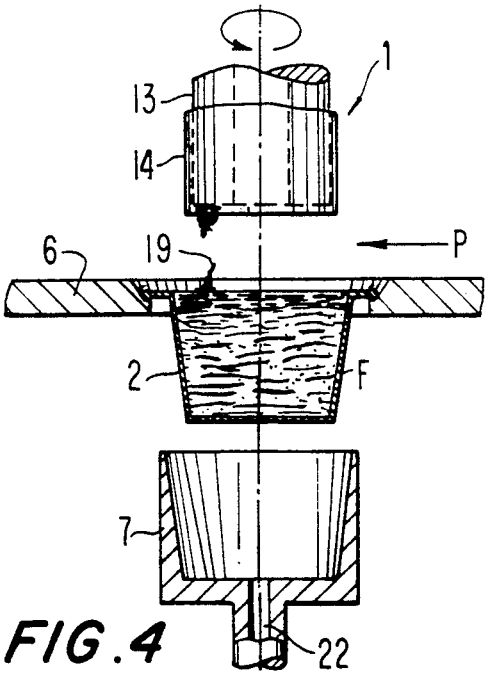

The transport plate 6 is disposed horizontally in a plane below the filling head 1 and above the support cage 7, displaceably designed by means of a driving means (not shown) in this plane in the advance direction P (cf. arrows in FIGS. 4 and 5) and lockable during the filling operation below the filling head 1 in a filling position. The transport plate has a continuous plate opening 8. The edge area of the transport plate 6 surrounding this plate opening is set back with respect to the transport plate surface facing the filling head 1 and provided for the centering support of the receptacle edge flange 3.

The support cage 7 limits with its support cage walls 10 a receiving chamber 11, which corresponds with slightly larger dimensions to the shape of the receptacle 2. The receptacle can be fixed in the support cage by means of vacuum. The upper edge of the support cage walls 10 designated as support cage edge 12 is designed to support the receptacle edge flange 3. The outer dimensions of the support cage 7 are somewhat smaller than the outer dimensions of the plate opening 8.

In the present embodiment the filling head 1 is designed as an oblong cylinder 13 whose lower part is surrounded by a hollow cylinder 14 with a bottom 15 resting against the lower cylinder surface. The cylinder 13 is rotatable about its vertical longitudinal central axis M by means of a driving means (not shown), whereas the hollow cylinder 15 is stationarily designed. Apart from that, the filling head 1 is stationarily disposed.

A filling duct 16 which is connected to a metering means (not shown) with an upstream feeding reservoir for the filling material F, traverses the cylinder 13 and opens at the lower cylinder surface with an outlet opening 17. The latter and the filling duct 16 are of the same cross-sectional size being however smaller with respect to the hollow cylinder 15. The filling duct 16 extends in such fashion obliquely to the longitudinal central axis M of the cylinder 13 that the outlet opening 17 is disposed eccentrically in the edge area of the lower cylinder surface. In its marginal area being in front in the advance direction P (in FIGS. 1 to 5 at the left from the longitudinal central axis M) the hollow cylinder bottom 15 is provided with a passage opening 18 which has the same size and shape as the outlet opening 17 and is disposed at the same radial distance from the longitudinal central axis M.

The cylinder 13 can be brought relative to the passage opening 18 by rotation into at least two positions, namely an open position and a closing position. In the open position represented in FIG. 3 both openings 17, 18 are disposed in superimposed fashion and thus allow the discharge of the filling material F out of the filling head under the action of a pressing out force generated in metering means connected upstream. In the closing position shown by way of example in FIG. 1 both openings 17, 18 are on the other hand remote from each other so that no filling material F can be discharged from the filling head 1. Upon the rotation from the open into the closed position the filling material F discharged by the filling head 1 in the form of a filling material strand is separated. Thus the two openings 17, 18 represent a cutting means for the filling material strand.

The hollow cylinder bottom 15, the transport plate 6 and the support cage edge 12 extend in parallel to each other. The support cage 7 is disposed coaxially to the filling head 1 so that its vertical longitudinal central axis M is at the same time the central axis M common to the two components 1, 7. The transport plate 6 is in the filling position with its plate opening 8 centrally to this common central axis M in the rest position. The support cage 7 is designed rotatably about the central axis M by means of a driving means (not shown) and can moreover be lifted by means of a lifting means (also not shown) along the central axis M from the lower position shown in FIG. 1 through the plate opening 8 up to an upper position represented in FIG. 3. The movement back into the lower position is positively controlled by means of a cam plate (not shown). The hollow cylinder bottom 15 has with somewhat smaller dimensions substantially the same shape and the same size of the receptacle bottom 4 and represents the counter-bottom.

In the following the function of the device according to the invention described above is explained.

Prior to the beginning of the filling process the transport plate 6 is with its plate opening 8 outside the filling head area so that a receptacle 2 can be inserted into the plate opening 8. Thereupon the transport plate 6 with inserted receptacle 2 is displaced in the advance direction P in its filling position shown in FIG. 1. The cylinder 13 of the filling head 1 adopts its closing position and the support cage 7 adopts its lower position with a distance between the receptacle bottom 4 and the support cage edge 12.

Figure 2:
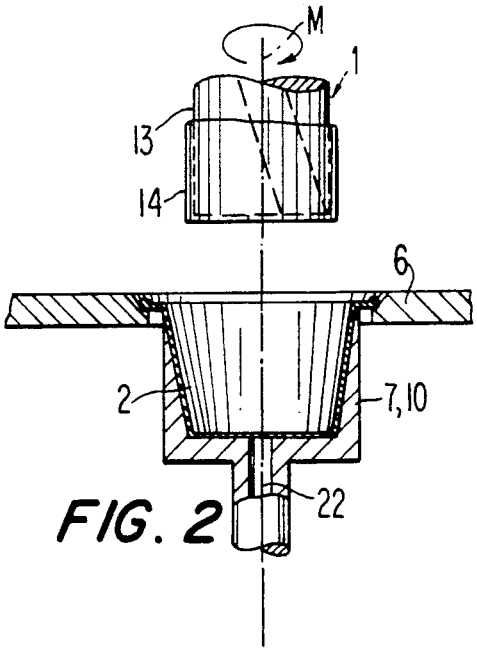

During the subsequent lift movement of the support cage 7 the same passes through the plate opening 8 of the transport plate 6, the flying take-over of the receptacle taking place. This is represented in FIG. 2. At the same time the rotation of the cylinder 13 from its closing position towards its open position begins.

Figure 3:
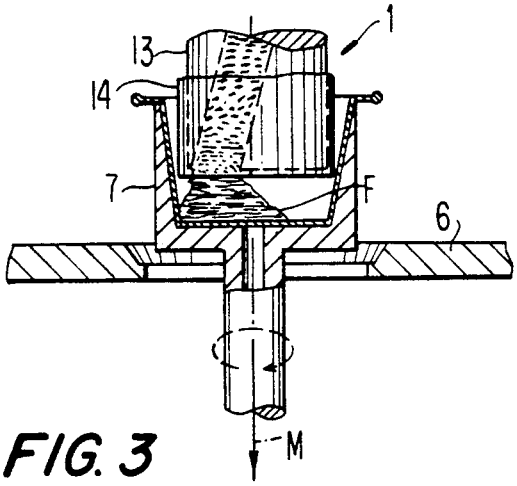

According to the representation in FIG. 3 the cylinder 13 has reached its open position and the support cage 7 with the receptacle 2 has reached its upper position. In this position the filling head 1 is already immersed into the receptacle already rotating now to such an extent that during the subsequent filling process the filling material filled into the receptacle does not come into contact with the hollow cylinder bottom 15. The support cage 7 is lowered with the receptacle 2 in positive control and rotated at the same time about the central axis M, while the filling material due to the pressing out force exerted in the feeding reservoir is pessed through the filling duct 16, the outlet opening 17 and the passage opening 18 with compression and homogenizing into the space between the receptacle bottom 4 and hollow cylinder bottom 15. The positive control is effected in such fashion that during the entire filling operation a distance is maintained between the hollow cylinder bottom 15 and the filling material located in the receptacle 2. The distance is dimensioned so that the filling material filled in does not come into contact with the hollow cylinder bottom 15 and thus does not adhere to it. This prevents an inaccurate filling of the receptacle, air inclusions and soiling of the receptacle edge flange. The compressed and homogenized filling material strand is distributed very uniformly in the receptacle without air inclusions due to its comparatively small cross-section, the rotation of the support cage 7 with the receptacle 2 and the eccentric filling in. The distance between the hollow cylinder bottom 15 and the filling material F filled in is maintained by the positive control and ensures that the filling material strand has a relatively small length and thus runs into the receptacle in uniform flow and without being torn off. In this fashion also viscous pastelike and inhomogenous filling material is filled into the receptacle 2 very uniformly, practically without air inclusions and without over-charge and soiling of the receptacle edge flange 3.

To give the receptacle a secure support during the rotation of the support cage supporting it it is fixed in the support cage in a manner as to prevent rotation by a suited means in a frictional connection or form-fit fashion. In advantageous fashion the receptacle is sucked by means of vacuum 22 against the inner wall of the support cage for this purpose.

Figure 5:
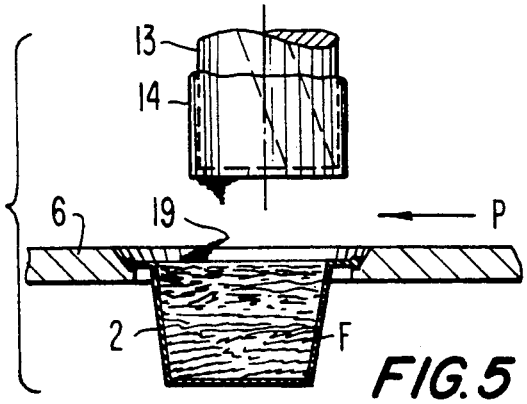

As soon as the filling material filled in has reached the desired filling level, the cylinder 13 is rotated into its closing position with continued rotation and lowering of the support cage 7, whereby the filling material strand is cleanly sheared off between the lower cylinder surface and the surface of the hollow cylinder bottom 15 resting against the same in an exactly defined plane and is detached from the part of the lower cylinder surface closing the passage opening 18. Now the support cage 7 is lowered into the lower position shown in FIG. 4 and the filled receptacle is delivered to the transport plate 6 for support on the edge area 9. In the case of especially viscous pastelike and fibrous material it may happen that a remainder (19) of the filling material strand projects upwardly from the filling material in in the manner shown in FIG. 4. To prevent that this projecting remainder 19 soils the receptacle edge flange 3 in particular during the subsequent closing of the receptacle 2, the transport plate 6 is moved out of the filling head range in the advance direction P with such a high acceleration that the filling material remainder 19 turns over contrary to the advance direction P, as shown in FIG. 5. Since the filling material was filled into the area of the receptacle 2 being in front in the advance direction P, the projecting filling material remainder turns over into the central area of the receptacle 2 so that soiling of the receptacle edge flange 3 is reliably avoided.

Figure 6:
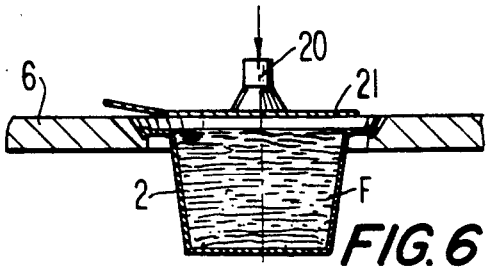

As represented in FIG. 6 a cover 21 can now be placed on the receptacle edge flange by means of a closing cylinder 20 and either be beaded around the edge flange to form a bead closure or be sealed on the same to form a sealing closure or be closed an another fashion.

We claim:

1. In a process for the filling of receptacles with doughy filling material by means of a receptacle receiving means being movable to and fro along a common vertical central axis relative to a filling head and an outlet opening for the filling material in the filling head, the receptacle receiving means with the receptacle being guided in relative movement with respect to the filling head into a position in which the receptacle bottom is at or close to the filling head and the filling material then being pressed out of the filling head and into the receptacle under the effect of a pressing force and at the same time the receptacle receiving means with the receptacle being returned in a relative movement from the filling head, the steps of (a) pressing the filling material (F) in the form of a filling material strand with comparably small cross-sectional surface eccentrically to the vertical central axis (M) into the continuously enlarging space between the receptacle bottom (4) and a counter-bottom (15) providing a passage opening (18) traversed by the outlet opening (17) and attached to the end of the filling head (1) facing the receptacle bottom (4), (b) during this filling operation, at least temporarily rotating the receptacle (2) with the receptacle receiving means (7, 10) about the central axis (M) relative to the filling head (1), and, (c) after the completion of the filling operation, separating the filling material strand in an exactly defined plane by moving the outlet opening (17) relative to the passage opening (18) such that the openings (17, 18) function as a means for cutting the strand in said plane.

2. A process according to claim 1, characterized in that during the filling process the counter-bottom (15) is kept at a distance from the filling material (F) filled into the receptacle (2).

3. A process according to claim 1, characterized in that pressure acts upon the filling material (F) filled into the receptacle (2) during the filling operation in the space between the receptacle bottom and the counter bottom (15).

4. A process according to claim 1, 2 or 3, characterized in that the receptacle (2) is also rotated about the common central axis (M) in relative rotation to the filling head (1) after the completion of the filling operation.

5. A process according to claim 4, characterized in that the receptacle receiving means (7, 10) is also moved back in relative movement to the filling head (1) after the completion of the filling operation.

6. A process according to claim 5, with the step of the removal of the filled receptacle from the filling head area by an advance movement being substantially directed transversely to the common central axis, characterized in that the filling material (F) is filled eccentrically into the area of the receptacle (2) being at the front in the advance direction (P).

7. A process according to claim 6, characterized in that the receptacle (2) is removed from the filling head area at such a high acceleration that remainder (19) of the separated filling material strand possibly projecting from the filling material (F) filled in turns over.

8. A process according to claim 1, characterized in that the receptacle (2) can be returned from the filling head (1) in a relative movement being decelerated by a counter-force being smaller as compared with the pressing force.

9. A process according to claim 1, characterized in that the receptacle (2) can be returned from the filling head (1) in a relative movement being decelerated by a counter-force being at least temporarily greater than the pressing force.

10. A device for the filling of receptacles with doughy filling material comprising a support means for receiving the receptacle and a filling head disposed above the support means and having an outlet opening for the filling material, the receptacle being movable from below the filling head into a position in which its bottom is at or close to the filling head, and back, the movement being a vertical relative movement with respect to the filling head along a common central axis (M), wherein the filling head (1) comprises a hollow cylinder (14) surrounding a lower part of an inner cylinder (13), that is traversed by a filling duct (16) opening into the outlet opening (17), said inner cylinder (13) being rotatable relative to said hollow cylinder (14) around said common central axis (M), said hollow cylinder (14) having a bottom (15) resting against a lower surface of said cylinder (13), which bottom constitutes a counter-bottom providing a passage opening (18) for the filling material (F), said passage opening (18) being disposed eccentrically to said axis (M), said passage opening (18) being superimposed by said outlet opening (17) defining an open position of the filling head and being convertible by means of the relative rotation of the inner cylinder (13) defining a closing position in which the outlet opening is removed from the passage opening (18).

11. A device according to claim 10, characterized in that the outlet opening (17) is comparatively smaller in size than the counter-bottom (15) and in that the receptacle (2) is rotatable about the common central axis (M) relative to the filling head (1).

12. A device according to claim 10 or 11, characterized in that the counter-bottom (15) is designed substantially congruently to the receptacle bottom (4).

13. A device according to claim 9 or 10 for the filling of receptacles with a continuous receptacle edge flange, characterized in that the support means is formed as a transport plate (6) and a support cage (7) for receiving the receptacle (2) and supporting the receptacle edge flange (3) by means of a support cage edge (12), the transport plate supporting, with an edge area (9) surrounding a plate opening (8), the receptacle edge flange (3) and being displaceable in the advance direction (P) towards the outside of the filling head area, the support cage (7) being movable from below the transport plate (6) through the plate opening (8) to above the same in the direction to the filling head (1), and back, and being rotatable about the central axis (M).

14. A device according to claim 13, characterized in that the inner contour of the support cage (7) is adapted to the outer contour of the receptacle (2).

15. A device according to claim 13, characterized in that the receptacle (2) is fixed in the support cage (7) in a manner as to prevent rotation by form closure or frictional connection.

16. A device according to claim 15, characterized in that the receptacle (2) is fixed in the support cage (7) by means of vacuum.

17. A device according to claim 1, characterized in that the vertical relative movement of the receptacle (2) to the filling head (1) is positively controlled during the returning for the purpose of maintaining a distance between the receptacle bottom (4) and the counter-bottom (15).

18. A device according to claim 10, the support means being displaceable towards the outside of the filling head area in an advance movement being substantially directed transversely to the central axis, characterized in that the outlet opening (17) is directed with respect to the common vertical central axis (M) eccentrically to the area of the support means being in front in the advance direction (P).

19. A device according to claim 18, characterized in that the support means can be displaced towards the outside of the filling head area with such a high acceleration that a remainder (19) of the separated filling material strand possibly projecting from the filling material (F) filled in is turned over.

20. A device for carrying out a process for the filling of receptacles with doughy filling material by means of a receptacle receiving means being movable to and fro along a common vertical central axis relative to a filling head and an outlet opening for the filling material in the filling head, the receptacle receiving means with the receptacle being guided in relative movement with respect to the filling head into a position in which the receptacle bottom is at or close to the filling head and the filling material then being pressed out of the filling head and into the receptacle under the effect of a pressing force and at the same time the receptacle receiving means with the receptacle being returned in a relative movement from the filling head, thereby to provide a continuously enlarging space between the receptacle bottom (4) and a counter-bottom (15) traversed by the outlet opening (17) and attached to the end of the filling head (1) facing the receptacle bottom (4), the filling material (F) being pressed in the form of a filling material strand with comparably small cross-sectional surface eccentrically to the vertical central axis (M) into said continuously enlarging space, and during this filling operation the receptacle (2) with the receptacle receiving means (7, 10) being at least temporarily rotated about the central axis (M) relative to the filling head (1), said device comprising (a) support means for receiving the receptacle and (b) a filling head disposed above the support means and having an outlet opening for the filling material, out of which the filling material can be pressed out and pressed into the receptacle under the action of a pressing force, the receptacle being movable from below the filling head, into a position in which its bottom is at or close to the filling head, and back, the movement being a vertical relative movement with respect to the filling head along a common central axis, the filling head (1) having at its end facing the receptacle bottom (4) a counter-bottom (15) traversed eccentrically to the central axis (M) by the outlet opening (17) of comparatively smaller size, and the receptacle (2) being rotatable about the common central axis (M) relative to the filling head (1), (c) said filling head comprising a first cylinder (13) having a lower part and a lower surface, and a hollow second cylinder (14) surrounding the lower part of the first cylinder (13) and containing said first cylinder (13), said first cylinder (13) being rotatable relative to the hollow second cylinder (14), said second cylinder having a bottom (15) resting against said lower surface, which bottom constitutes the counter-bottom and has a passage opening (18) for the filling material (F), which passage opening is disposed eccentrically to the common central axis (M), (d) an open position of the filling head, in which the passage opening (18) is superimposed by the outlet opening (17), being convertible, by rotation of the first cylinder (13) relative to the second cylinder, to a closing position in which the outlet opening is removed from the passage opening (18).

* * * * *